US009809945B1

(12) United States Patent
Middleton

(10) Patent No.: US 9,809,945 B1
(45) Date of Patent: Nov. 7, 2017

(54) METHOD, APPARATUS, AND KIT FOR PROVIDING AN ADAPTER ON EARTH MOVING EQUIPMENT

(71) Applicant: Robert Middleton, Budd Lake, NJ (US)

(72) Inventor: Robert Middleton, Budd Lake, NJ (US)

( * ) Notice: Subject to any disclaimer, the term of this patent is extended or adjusted under 35 U.S.C. 154(b) by 154 days.

(21) Appl. No.: 14/732,839

(22) Filed: Jun. 8, 2015

(51) Int. Cl.
*E02F 3/36* (2006.01)
*E02F 3/96* (2006.01)

(52) U.S. Cl.
CPC ..... *E02F 3/3604* (2013.01); *E02F 3/964* (2013.01); *Y10S 37/903* (2013.01); *Y10T 29/4973* (2015.01); *Y10T 403/595* (2015.01)

(58) Field of Classification Search
CPC ..... E02F 3/3672; E02F 3/3627; E02F 3/3668; E02F 3/964; E02F 3/3604; Y10T 403/595; Y10T 403/599; Y10T 29/4973; Y10T 29/49735; Y10T 29/49739; Y10S 37/903; B60P 6/00
USPC ..... 414/723, 72, 724; 37/468, 403, 409; 403/321, 324, 325
See application file for complete search history.

(56) References Cited

U.S. PATENT DOCUMENTS 3,672,521 A * 6/1972 Bauer ..... E02F 3/3622 414/723
3,794,195 A * 2/1974 Clevenger ..... E02F 3/3631 414/723
3,985,249 A * 10/1976 Aker ..... E02F 3/3631 172/275
4,085,856 A * 4/1978 Westendorf ..... E02F 3/3627 172/273
4,436,477 A * 3/1984 Lenertz ..... E02F 3/3622 37/403
4,464,852 A 8/1984 Rice
4,488,850 A * 12/1984 Wernimont ..... E02F 3/3618 37/407
4,966,240 A 10/1990 Aikawa
4,986,722 A * 1/1991 Kaczmarczyk ..... E02F 3/3622 172/272
5,098,252 A * 3/1992 Sheesley ..... E02F 3/3627 172/273
5,107,610 A * 4/1992 Fusco ..... E02F 3/3627 37/444
5,403,144 A * 4/1995 Staben, Jr. ..... E02F 3/3677 172/272

(Continued)

*Primary Examiner* — Joshua J Michener
*Assistant Examiner* — Matthew Gitlin
(74) *Attorney, Agent, or Firm* — Thomas L. Adams

(57) ABSTRACT

A frame has a crosspiece with a pair of longitudinal branches, and is used for installing an adapter on earth moving equipment. This equipment has an implement support structure with one or more bearing plates for accommodating azimuthal rotation of a working implement. This working implement is removed from the implement support structure before attaching a frame there. The frame's crosspiece has walls that engage the bearing plates on the implement support structure. An adapter is rotatably mounted on the frame. Any one of a plurality of working accessories can be selected and installed on the adapter. For equipment that originally lacked bearing plates, a cross member with bearing plates is provided in a kit. The frame will then attach to the kit's cross member and to the implement support structure.

24 Claims, 5 Drawing Sheets

(56) References Cited

U.S. PATENT DOCUMENTS 5,562,397 A * 10/1996 Albright ..... E02F 3/364 37/468
5,597,283 A * 1/1997 Jones ..... E02F 3/3627 37/468
5,692,855 A * 12/1997 Burton ..... E02F 3/3631 172/272
6,390,765 B1 * 5/2002 Dick ..... E02F 3/3627 37/468
6,619,906 B2 * 9/2003 Dick ..... E02F 3/3627 37/468
6,851,916 B2 * 2/2005 Schmidt ..... E02F 3/3604 37/468
7,073,972 B1 * 7/2006 Schumacher ..... E02F 3/3627 403/382
7,108,475 B1 * 9/2006 Gustafson ..... A01B 59/062 280/416.2
7,513,732 B1 * 4/2009 Callens ..... E02F 3/3627 37/468
7,524,158 B2 * 4/2009 Eckstein ..... E02F 3/3627 37/468
7,690,441 B2 4/2010 Matsumoto et al.
7,699,577 B2 * 4/2010 Lougheed ..... A01B 59/062 37/468
7,824,145 B2 * 11/2010 Kisse ..... E02F 3/3414 37/468
8,024,875 B2 * 9/2011 Wetzel ..... E02F 3/325 37/403
8,700,271 B2 4/2014 Evenson et al.
8,763,226 B1 * 7/2014 Gustafson ..... E02F 3/3604 29/281.1
8,979,468 B2 * 3/2015 Oyama ..... E02F 3/3627 403/322.4
9,004,845 B2 * 4/2015 Bernier ..... E02F 3/32 414/723
2007/0025834 A1 * 2/2007 Gustafson ..... E02F 3/3604 414/723
2007/0134081 A1 * 6/2007 Seabolt ..... E02F 3/08 414/723
2011/0211903 A1 * 9/2011 Ramun ..... E02F 3/302 403/31
2014/0317967 A1 * 10/2014 Parker ..... E02F 3/325 37/403

* cited by examiner

METHOD, APPARATUS, AND KIT FOR PROVIDING AN ADAPTER ON EARTH MOVING EQUIPMENT

BACKGROUND OF THE INVENTION

1. Field of the Invention

The present invention relates to earth moving equipment, and in particular, to devices and methods for enabling such equipment to work with a variety of working accessories.

2. Description of Related Art

Some earth moving equipment are dedicated to a single purpose. For example, some (but not all) excavators or bulldozers are fitted with a bucket or dozer blade that is not easily replaced with a different type of working implement. Other equipment such as skid steer loaders are typically designed with adapters that can handle any one of a number of different working accessories. Potential accessories include augers, buckets, forklifts, grapplers, graders, spreaders, scarifiers, scrapers, tillers, etc.

Clark Equipment Co. (North Dakota) offers a Bob-Tach mounting system that allows an operator to quickly replace one type of working accessory with another type. This commercially available adapter has an upper edge designed to fit into a pocket of an working accessory, and a lower edge fitted with locking pins that can be pushed into complementary holes in a lower ledge of the accessory. In practice, the adapter is simply driven into a position to catch the pockets of the accessory, before being lifted, and then latched in place by manually operating levers that drive the locking pins into the accessory's holes.

Some compact excavators include a dozer blade mounted on a support structure that can articulate in order to lift/lower the dozer blade. The lifting/lowering of the blade is accomplished by a central hydraulic cylinder. In some cases the excavator's dozer blade is supported in bearing plates that allow the blade to swing azimuthally, and a side mounted hydraulic cylinder is used to effectuate this swinging.

A dozer blade mounted in this fashion is not readily replaced with another type of working accessory. Moreover, even if replacement were feasible, the native support structure does not provide the ability to adjust the pitch angle of the accessory, an adjustment that can be very important in many applications.

If the type of working accessory cannot be easily changed, then many dedicated pieces of earth moving equipment may be needed at a worksite. Some of the dedicated equipment may remain idle waiting for its turn. In some cases the various pieces of dedicated equipment may be scheduled to arrive on different days to avoid downtime, but this greatly extends the work schedule and delays the completion date.

See also U.S. Pat. Nos. 4,966,240; 4,464,852; 7,690,441; 8,700,271; and 8,024,875; as well as U. S. Patent Application Publication No. 2014/0317967.

SUMMARY OF THE INVENTION

In accordance with the illustrative embodiments demonstrating features and advantages of the present invention, there is provided a method employing a frame for installing an adapter on earth moving equipment. The earth moving equipment has a working implement mounted on an implement support structure. The method includes several steps, performed in any order. The method includes the step of removing the working implement from the implement support structure. Another step is attaching the frame on the implement support structure. The method also includes the step of mounting the adapter on the frame. Another step is installing a selected one of a plurality of working accessories on the adapter.

In accordance with another aspect of the invention, there is provided apparatus that is adapted to attach to earth moving equipment. The earth moving equipment has an implement support structure with one or more bearing plates for accommodating azimuthal rotation of a working implement. The apparatus includes a frame adapted to attach to the implement support structure. The apparatus also includes an adapter rotatably mounted on the frame. Also included is a working accessory installed on the adapter.

In accordance with yet another aspect of the invention, there is provided a kit for modifying earth moving equipment that has an implement support structure. The kit includes a cross member adapted to be affixed to the implement support structure. The cross member has one or more bearing plates each with a bearing aperture. The kit also includes a frame adapted to attach to the cross member and the implement support structure. Also included is an adapter rotatably mounted on the frame. The kit also includes a working accessory installed on the adapter. The frame includes a crosspiece, a spaced pair of longitudinal branches affixed to the crosspiece. The crosspiece has an upper and a lower wall for engaging the one or more bearing plates. The longitudinal branches are adapted to attach to the implement support structure.

By employing methods and apparatus of the foregoing type, one is able to significantly improve the adaptability of earth moving equipment. In a disclosed embodiment an excavator was originally manufactured with a dozer blade that cannot be easily replaced with another working accessory. In its original form, this dozer blade was pivotally mounted in apertures in a pair of vertically spaced bearing plates that allow the blade to swing azimuthally (change in yaw).

The present specification teaches removing the dozer blade from the excavator. The remaining support structure is then fitted with a frame designed to attach to this support structure. In this disclosed embodiment the retrofit frame has a parallel pair of branches that mount onto the excavator's, pre-existing parallel beams, which were previously used to support the now-removed dozer blade. This retrofit frame also has in front a crosspiece with upper and lower walls that fit around the excavator's pre-existing bearing plates. Apertures in the upper and lower walls of the crosspiece align with bearing apertures in the excavator's bearing plates so that these components can be bolted together.

An adapter is rotatably mounted to the crosspiece of the retrofit frame. The disclosed adapter is designed to support any one of a variety of working accessories. An outwardly turned upper edge of the adapter is designed to fit into a pocket of a substitute working accessory. The lower edge of the adapter slides over a lower flange on the accessory and is locked in place by pins that are manually driven into holes on the accessory's flange.

The pitch of the adapter and thus the accessory, can be adjusted by hydraulic actuators connected between the adapter and the parallel branches of the retrofit frame.

In some embodiments, the original working implement (e.g., the original dozer blade) is secured to the earth moving equipment in such a way that attaching the retrofit frame is only feasible by cutting through the structure supporting the implement. In such a case, the severed ends of the structure can be fitted with a cross member similar to that found on other types of earth moving equipment. In a disclosed embodiment, the retrofit cross member is a panel supporting a spaced pair of parallel bearing plates with vertically aligned bearing apertures. Because the thus modified structure mimics that found on other types of earth moving equipment, a standard frame can be installed on both types of equipment.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION

Figure 1:
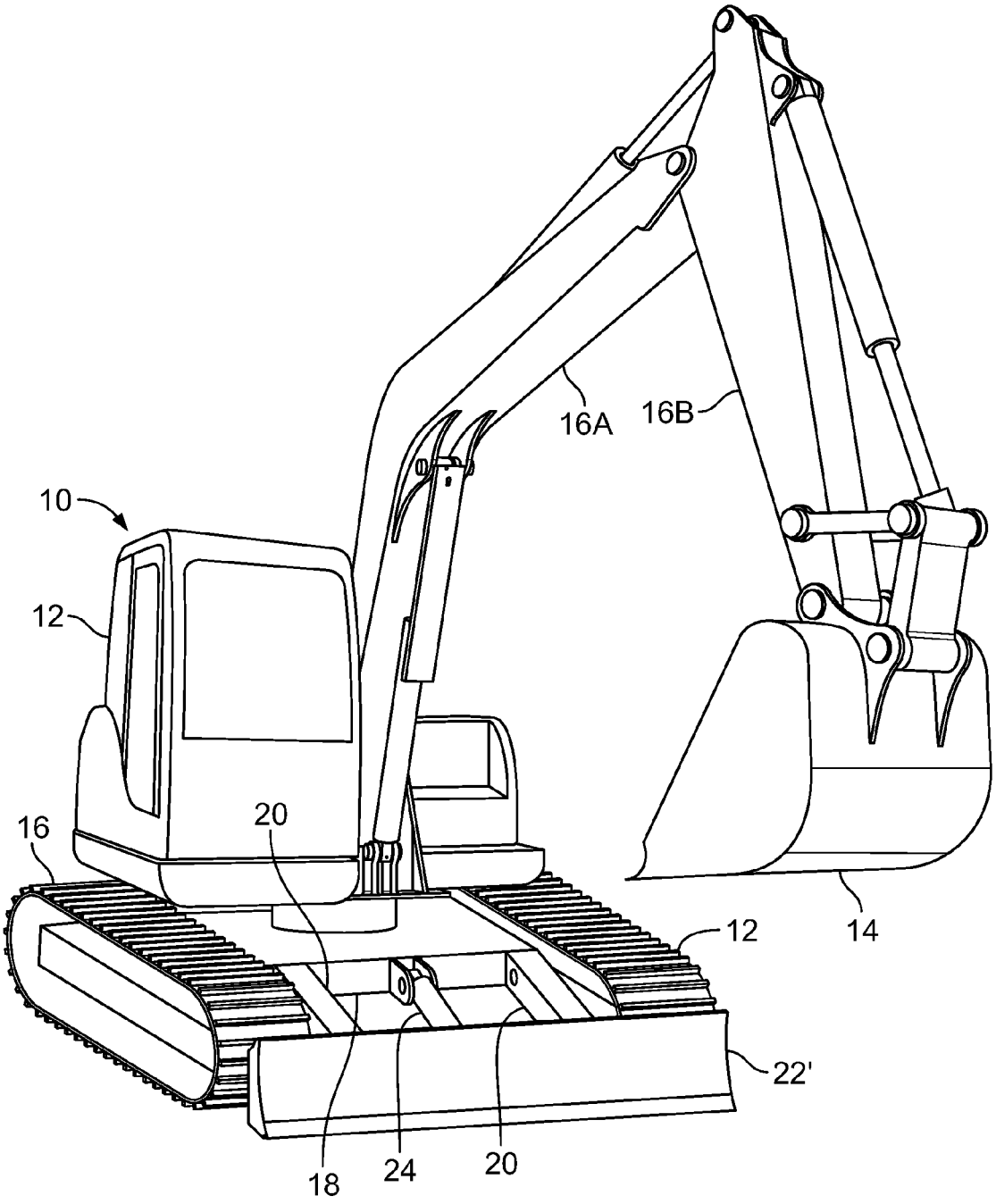
FIG. 1 (PRIOR ART)
FIG. 1 is a perspective view of an excavator fitted with a dozer blade in a manner known to the prior art.

Referring to FIG. 1, the illustrated, conventional piece of earth moving equipment is shown as track-mounted excavator 10 having cab 12 and bucket 14. The bucket 14 is mounted on boom 16A/16B. The undercarriage of excavator 10 includes a transverse beam 18 that pivotally supports articulated arms 20, which in turn support a working implement in the form of dozer blade 22 (also referred to as an earth moving blade). Hydraulic cylinder 24 is supported on beam 18 and can lift/lower arms 20 and blade 22.

Figure 2:
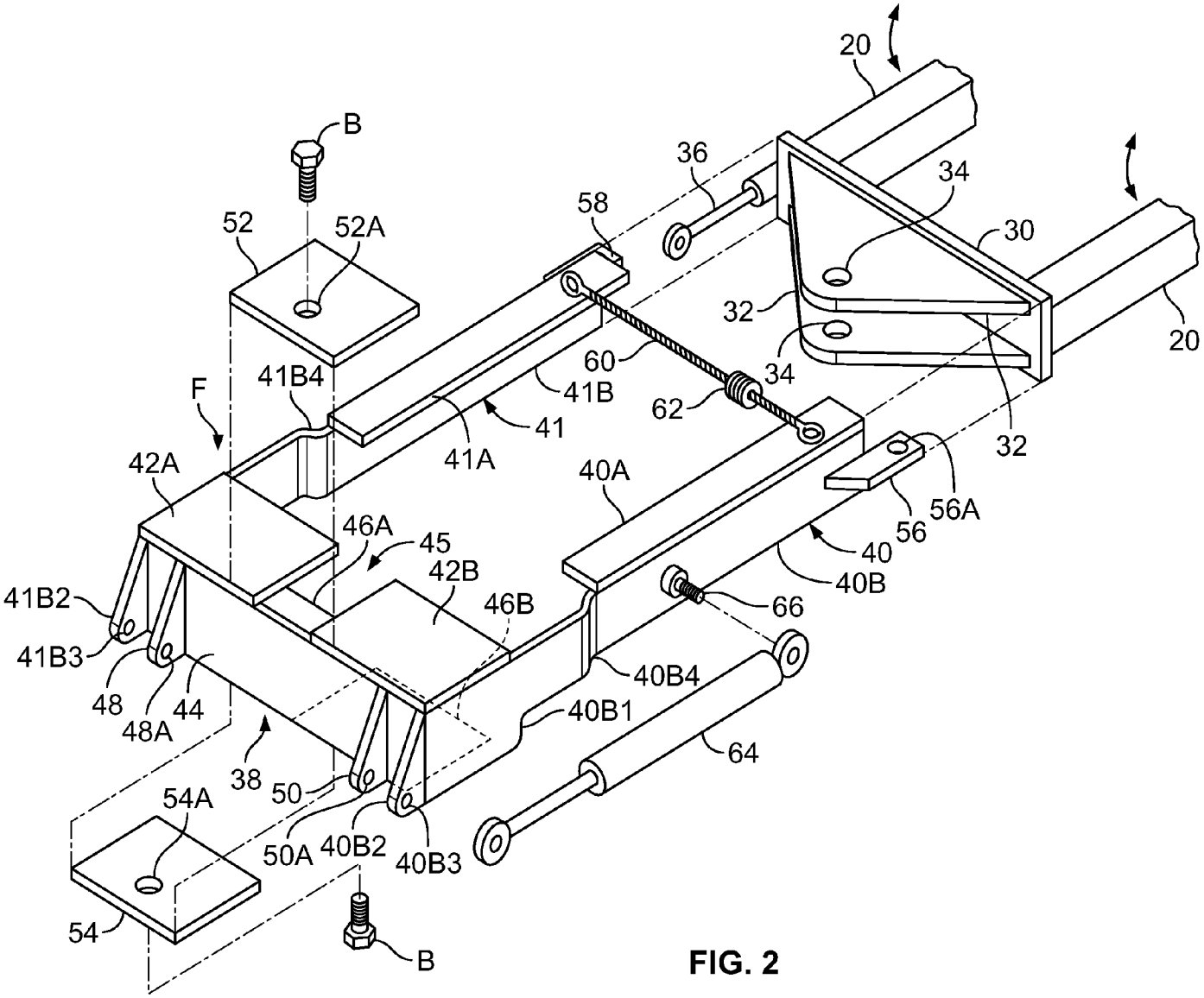
FIG. 2 is a fragmentary, exploded, perspective view of apparatus that is used to install an adapter on earth moving equipment, in accordance with principles of the present invention.
Figure 3:
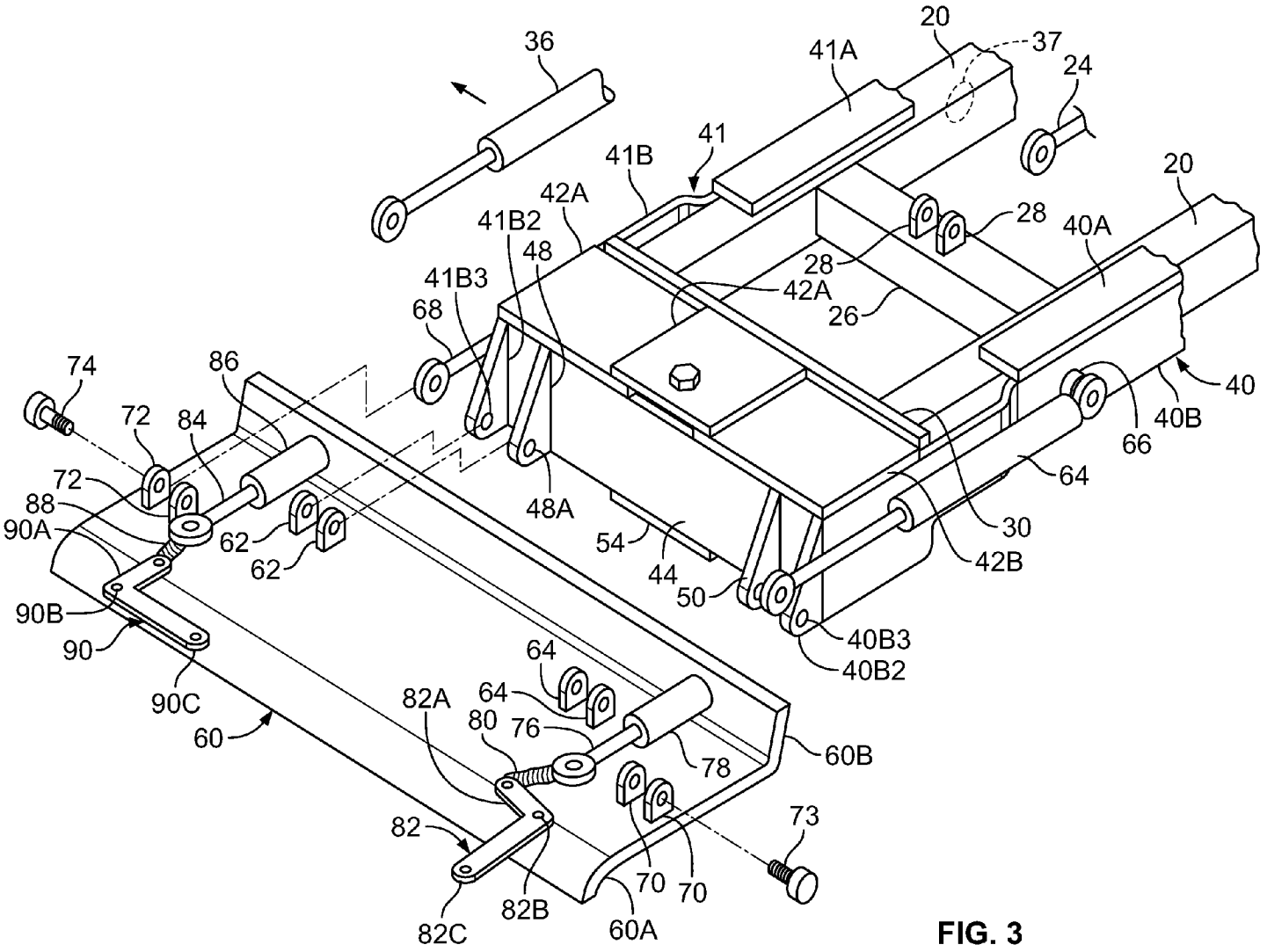
FIG. 3 a fragmentary, exploded, perspective view of the apparatus of FIG. 1 shown in a more advance state of assembly and with an adapter about to be installed in place.

Referring to FIGS. 1-3, brace 26 is shown in FIG. 3 connecting between previously mentioned articulated arms 20 and is fitted with a pair of knuckles 28 that attach to the distal end of previously mentioned hydraulic cylinder 24. The distal ends of arms 20 are shown in FIG. 2 affixed to the proximal face of cross member 30. Attached to the distal face of cross member 30 are a parallel pair of bearing plates 32 that each have an aligned pair of bearing apertures 34. Arms 20, cross member 30, and plates 32 are herein referred to as an implement support structure.

In the original configuration, the proximal side of dozer blade 22 (FIG. 1) has a pair of bearing plates (not shown) that are rotatably mounted in bearing apertures 34 of bearing plates 32 (FIG. 2). Azimuthal actuator 36 (FIG. 3) is originally connected between dozer blade 22 and actuator joint 37 on the outside of one of the arms 20 (right arm from the perspective of the operator in cab 12). Accordingly, actuator 36 is able to rotate dozer blade 22 azimuthally about the axis provided by bearing apertures 34.

The installation of the new apparatus begins by disconnecting azimuthal actuator 36 from arm 20 and dozer blade 22. Thereafter dozer blade 22 is detached from bearing plates 32, leaving the plates exposed.

A retrofit frame F is shown herein as a pair of longitudinal branches 40 and 41 attached to opposite ends of crosspiece 38. Crosspiece 38 has a front plate 44 and a spaced pair of top plates 42A and 42B that run the length of the crosspiece except for a central gap 45. A similar pair of plates 46A and 46B run along most of the bottom of crosspiece 38 except for a gap that is vertically aligned with gap 45.

Frame F is supplied with gap 45 and the corresponding gap between plates 46A and 46B covered by bearing plates 52 and 54 (compare FIGS. 2 and 3), which have aligned bolt holes 52A and 54A, respectively. Plates 52 and 54 are also referred to herein as an upper and lower wall, respectively. Crosspiece 38 and plates 52 and 54 may be made of steel that is welded together, although different materials and assembly methods may be employed in other embodiments.

Longitudinal branch 40 has a top plate 40A perpendicularly attached to the rear upper edge of side plank 40B. Side plank 40B has a uniform height except that the vertical dimension increases in front of jog 40B1, leading to a tapered nose 40B2 having a bearing hole 40B3. Longitudinal branch 41 is the mirror image of branch 40 and the branches have a uniform separation except for jogs 40B4 and 41B4 which introduces a greater separation for the distal ends of planks 40B and 41B. Longitudinal branch 41 also has a top plate 41A and a distal nose 41B2 with bearing hole 41B3. Both branches 40 and 41 can be made of steel and welded together, although different materials and assembly methods may be employed in other embodiments.

The inside faces of the distal ends of planks 40B and 41B are attached to the ends of crosspiece 38, with noses 40B2 and 41B2 extending past front plate 44. Sloped stubs 48 and 50 are attached to the front of plate 44 and have an outline matching that of noses 40B2 and 41B2. Stubs 48 and 50 have bearing holes 48A and 48B, respectively, that are aligned with bearing holes 40B3 and 41B3.

Frame F is installed by lifting branches 40 and 41 over plate 30 and resting the top plates 40A and 41A atop support arms 20. Arms 40 and 41 are pushed back until the original bearing plates 32 slide below plates 42A/42B and above plates 46A and 46B, so that original bearing holes 34 align with retrofit bearing holes 52A and 54A. Thereafter bolts B can be used to fasten bearing plates 32 to bearing plates 52 and 54. Specifically bolts B obtrude into the bearing holes 34 and are fastened by means of threads in the bearing holes of by means of separate nuts (not shown). Once fastened in this manner, plate 30 abuts plates 42A, 42B, 46A, and 46B as shown in FIG. 3 to prevent rotation of crosspiece 38 relative to plate 30. It will be noticed that jogs 40B4 and 41B4 provide additional clearance so that plate 30 does not interfere with planks 40B and 41B.

Attached to the proximal end of plank 40B is connector tab 56, which has a bolt hole 56A. On the other side, connector tab 58 is configured as a mirror image of tab 56 and is connected to the proximal end of plank 41B. In many cases arms 20 will be originally manufactured with connection joints such as previously mentioned actuator joint 37 (FIG. 3) that was originally attached to the proximal end of azimuthal actuator 36. The previously mentioned removal of azimuthal actuator 36 leaves behind a connection joint 37 that can then be connected to tab 58 to secure branch 41 in place. In this embodiment there is no corresponding connection joint that can mate with connector tab 56. Accordingly, an installer will attach a connector similar to that found originally at joint 37 in order to connect to tab 56.

Resilient line 60 is shown connected between the proximal ends of plates 40A and 41A. Spring 62 may be spliced into line 60 to maintain tension. Even though the proximal ends of branches 40 and 41 may be positively secured, line 60 will dampen vibrations that tend to occur with structure of this type.

In FIG. 3 adapter 60 is shown as a plate-like body with a first edge 60A on top, and below, a second edge 60B in the form of a ledge. A pair of knuckles 62 on the inside face of adapter 60 are designed to fit between bearing members 41B2 and 48. The bearing holes of knuckles 62 align with bearing holes 41B3 and 48A in order to receive a hinge pin (not shown). Likewise, a pair of knuckles 64 on the inside face of adapter 60 are designed to fit between and be hinged on\ members 40B2 and 50. Again, the bearing holes of knuckles 64 align with bearing holes 40B3 and 50A in order to receive a hinge pin (not shown). Members 41B2 and 48, as well as members 40B2 and 50, are referred to as frame bearings.

Being hinged on knuckles 62 and 70 the pitch angle of adapter 60 can be adjusted by pitch actuators 64 and 68 (shown as hydraulic cylinders). In particular, the proximal end of actuator 64 is pivotally attached to threaded stud 66 (FIGS. 2 and 3) on the outside of plank 40B. The distal end of actuator 64 will be mounted between knuckles 70 on adapter 60 and will pivot on hinge pin 73. Likewise, the distal end of pitch actuator 68 is mounted between knuckles 72 on adapter 60 and pivots on hinge pin 74. The proximal end of pitch actuator 68 it is attached to a threaded stud (not shown) on the outside of plank 41B. Actuators 64 and 68 will be connected by hydraulic lines (not shown) to conventional manual controls (also not shown) in cab 12.

Figure 4:
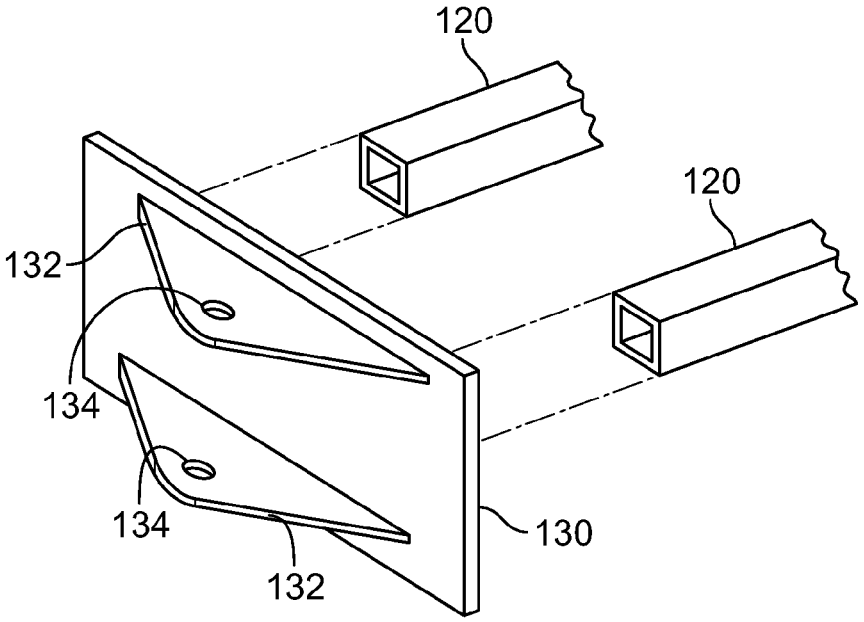
FIG. 4 is a fragmentary, exploded, perspective view of additional apparatus that is used in another embodiment to install an adapter when the equipment's implement support structure is different from that shown in FIG. 2.

A latching mechanism is shown in FIGS. 3 and 4 as a locking pin 76 slidably mounted in collar 78. Spring biased arm 80 is connected between the distal end of locking pin 76 and one branch of L-shaped lever 82, which is rotatably mounted at pivot 82B. A complementary latching mechanism on adapter 60 also has a locking pin 84 slidably mounted in collar 86 to be reciprocated through spring arm 88 by rotating lever 90 about pivot 90B. Latching mechanisms of this type or commercially available from Clarke Equipment Company under the trademark Bob-Tach. See U.S. Pat. No. 7,824,145.

To facilitate an understanding of the principles associated with the foregoing apparatus, its operation will be briefly described in connection with FIGS. 1-3 and 5-6. As previously described, dozer blade 22 of FIG. 1 is detached from bearing plates 32, and frame F is attached to the implement support structure 20, before installing adapter 60 as previously described. The pitch of adapter 60 can be adjusted by using actuators 64 and 68.

Figure 5:
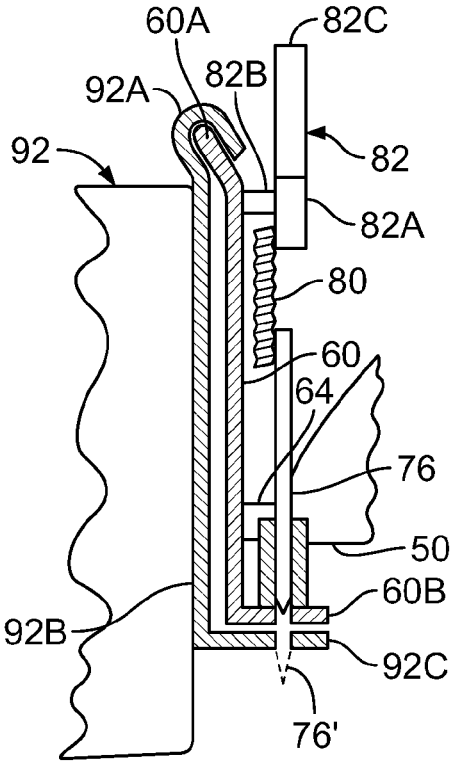
FIG. 5 is an elevational view, partly in section, of the adapter of FIG. 3 attached to a working accessory.

Excavator 10 may be moved forward on track 16 to bring adapter 60 next to working accessory 92 of FIG. 5. Specifically, adapter edge 60A is inserted into pocket 92A of accessory 92. This may be performed by using lift cylinder 24 to lower the elevation of adapter 60, thereby enabling adapter edge 60A to arrive under pocket 92A, before lifting adapter 60 to bring edge 60A into pocket 92A as shown in FIG. 5. The landing of edge 60A in pocket 92A can be facilitated by pitching edge 60A forward using pitch actuators 64 and 68. The pitch angle established by actuators 64 and 68 can be adjusted using hydraulic controls (not shown) that are located inside cab 12 of excavator 10.

As adapter is 60 is lifted, backplate 92B of accessory 92 rises, which allows accessory ledge 92C to swing under adapter ledge 60B as shown in FIG. 5. To execute this maneuver, locking pins 76 and 84 (FIG. 3) must be initially retracted. This is accomplished beforehand by swinging lever handles and 82C and 90C outwardly, that is, to the position shown for lever 82 of FIG. 3.

Thereafter, locking pins 76 and 84 are extended by swinging levers 82 and 90 inwardly (i.e., both swung into the position shown for lever 90 of FIG. 3). As shown in FIG. 5, locking pin 76 can extend through an aperture in ledge 92C. This deployed position is shown in phantom as extended pin 76'. Locking pin 84 will be deployed in a similar fashion. Extension of pins 76 and 84 will latch accessory 92 onto adapter 60.

The pitch angle of adapter 60 and accessory 92 can be adjusted by operating pitch actuators 64 and 68 using hydraulic controls (not shown) that are manually operated inside cab 12 of excavator 10.

Figure 6:
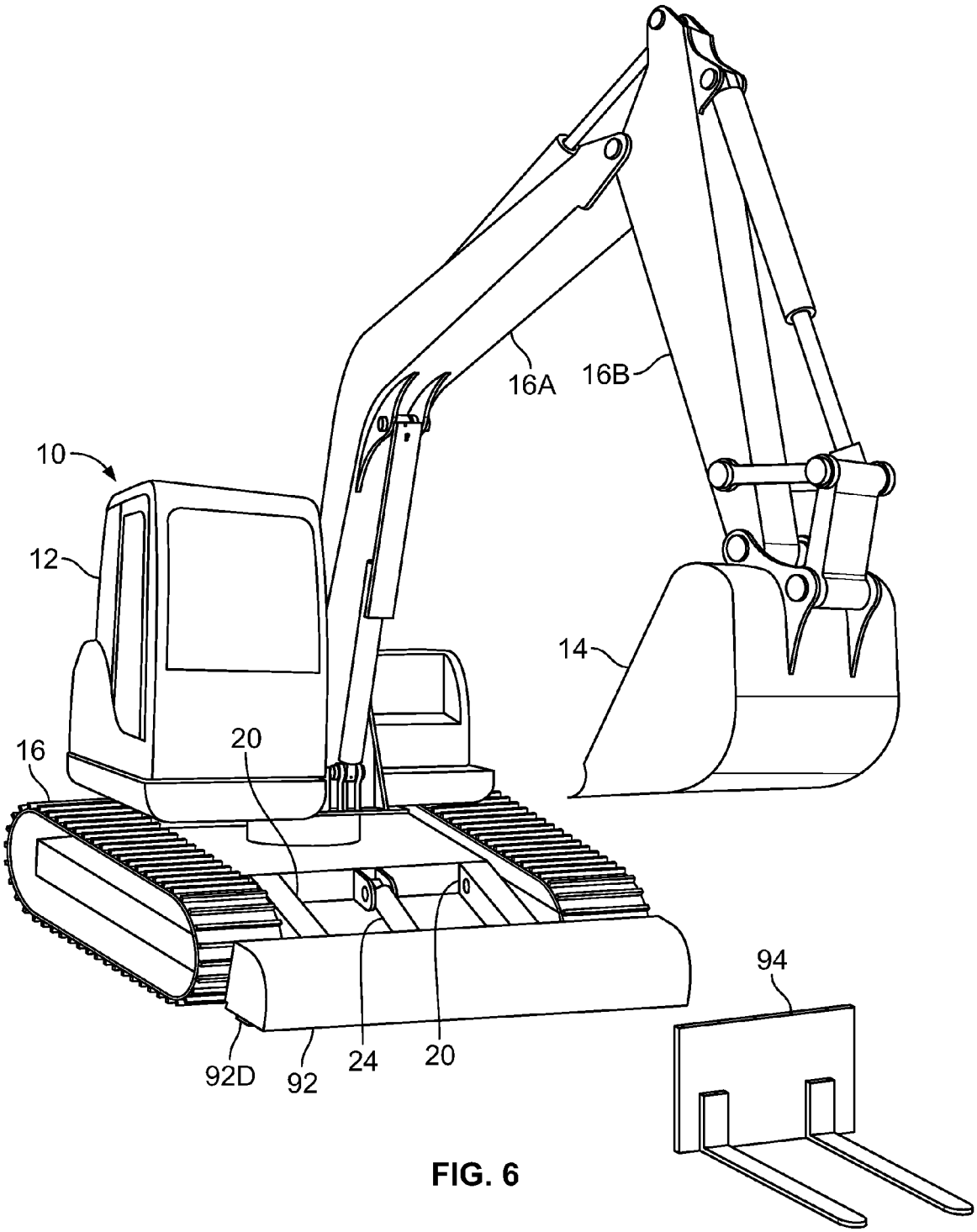
FIG. 6 is a perspective view of the excavator of FIG. 1 modified to use the apparatus of FIGS. 2 and 3.

Accessory 92 is any one of a variety of working accessories. The selected one shown in FIG. 6 is a tiller. For this situation hydraulic feed and return lines are connected between the excavator's hydraulic pump (not shown) and tiller 92 to spin its tines 92D.

Tiller 92 can be removed by swinging handles 82C and 90C outwardly to retract pins 76 and 84 from ledge 92C. Thereafter adapter 60 can be lowered to rest accessory 92 on the ground. Thereafter, adapter 60 can be pitched and excavator 10 can be moved backward to disconnect edge 60A from pocket 92A.

Once accessory 92 has been detached, adapter 60 is again exposed and ready to connect to another one of a variety of working accessories. In FIG. 6 this other accessory is shown as fork lift assembly 94. It will be understood that the back of accessory 94 has a pocket and ledge similar to pocket 92A and ledge 92C shown in FIG. 5. As before, adapter 60 will be maneuvered to land its edge 60A in the pocket of accessory 94, before lifting the accessory and then operating handles 82C and 90C to extend locking pins 76 and 84 in order to latch accessory 94 onto adapter 60.

In some cases dozer blade 22 of FIG. 1 is permanently attached and does not connect to the bearing plates 32 shown in FIG. 2. If necessary, one can remove the dozer blade by cutting its support structure with an appropriate torch or saw. Referring to FIG. 4, the implement support structure 120 is shown as two parallel beams that have been severed at their distal ends. Thereafter, a cross member in the form of steel plate 130 is welded onto the severed ends of structure 120. As before, a parallel pair of bearing plates 132 are attached to the distal side of cross member 30. Each of the bearing plates 132 have an aligned pair of bearing apertures 34.

Cross member 130, when attached in this fashion, is structurally equivalent to cross member 30 of FIG. 2. Accordingly, frame F of FIG. 2 can be attached to structure 120, cross member 130, and bearing plates 132 in the same manner as was described in connection with the arrangement of FIG. 2. Accordingly, frame F can become a standard assembly that is used on a variety of different types of earth moving equipment.

Obviously, many modifications and variations of the present invention are possible in light of the above teachings. It is therefore to be understood that within the scope of the appended claims, the invention may be practiced otherwise than as specifically described.

The invention claimed is:

1. A method for enhancing the ability of earth moving equipment originally built with an implement support structure having one or more bearing plates that supported a working implement in a predetermined manner, the method comprising the steps, performed in any order, of:

removing the working implement from the implement support structure;

attaching, on the implement support structure, a frame having a spaced pair of longitudinal branches that are affixed to a crosspiece having an upper and a lower wall, the attaching of the frame being performed to cause the upper and lower wall to engage the one or more bearing plates;

mounting an adapter on the frame to place the frame between the adapter and the implement support structure; and installing a selected one of a plurality of working accessories on the adapter to be supported in a manner different from the predetermined manner, the plurality of accessories being adapted to work upon earth or to move earth or objects.

2. A method according to claim 1 wherein the working implement comprises an earth moving blade.

3. A method according to claim 2 wherein the adapter has one or more reciprocatable locking pins, the step of locking onto the selected one of the plurality of working accessories is performed by thrusting the one or more locking pins into the selected one of the plurality of accessories.

4. A method according to claim 1 wherein the step of installing the selected one of the plurality of working accessories is performed by placing the selected one against an edge of the adapter accessory, and locking an opposite edge of the adapter onto the selected one of the plurality of accessories.

5. A method according to claim 1 wherein the selected one of the plurality of working accessories may be any one of the plurality of accessories.

6. A method according to claim 5 comprising the steps of:

removing the selected one of the plurality of working accessories from the adapter; and installing another one of the plurality of working accessories on the adapter.

7. A method according to claim 5 wherein the selected one of the plurality of accessories is operable to perform a function different from that performed by the working implement.

8. A method according to claim 1 comprising the steps of:

installing one or more pitch actuators between the frame and the adapter; and operating the one or more pitch actuators to provide an adjustable pitch angle for the adapter.

9. A method according to claim 1 wherein before removal, the working implement is journalled on the implement support structure.

10. A method according to claim 1 wherein before removal, the working implement is rotatably mounted on the implement support structure to allow azimuthal rotation of the working implement relative to the implement support structure.

11. A method according to claim 10 wherein the one or more bearing plates each has a bearing aperture for supporting the working implement before removal and for allowing azimuthal rotation of the working implement relative to the implement support structure, the step of attaching the frame on the implement support structure being performed by obtruding into the aperture of the one or more bearing plates.

12. A method according to claim 11 wherein the step of attaching the frame on the implement support structure is performed to avoid azimuthal rotation of said frame about the one or more bearing plates.

13. A method according to claim 12 wherein the earth moving equipment has an azimuthal actuator supported at an actuator joint on said implement support structure for azimuthally rotating said working implement, the method comprising the step of:

removing the azimuthal actuator; and attaching the frame to the actuator joint.

14. A method according to claim 1 comprising the step of:

connecting a resilient line to the frame, the frame having a pair of longitudinal branches each with a proximal end, the step of connecting the resilient line being performed by connecting the resilient line between the proximal ends of the pair of longitudinal branches.

15. A method for enhancing the ability of earth moving equipment originally built with an implement support structure that supported a working implement in a predetermined manner, the method comprising the steps, performed in any order, of:

removing the working implement from the implement support structure;

attaching a bearing plate with an aperture to the implement support structure;

attaching on the implement support structure a frame having a spaced pair of longitudinal branches that are affixed to a crosspiece having an upper and a lower wall, the attaching of the frame being performed to cause the upper and lower wall to engage the one or more bearing plates;

mounting an adapter on the frame to place the frame between the adapter and the implement support structure, the step of mounting the adapter being performed by obtruding into the aperture of the bearing plate; and installing a selected one of a plurality of working accessories on the adapter to be supported in a manner different from the predetermined manner, the plurality of accessories being adapted to work upon earth or to move earth or objects, the step of removing the working implement being performed by cutting near the joint between the working implement and the implement support structure.

16. An apparatus adapted to attach to earth moving equipment that has an implement support structure with one or more bearing plates for accommodating azimuthal rotation of a working implement relative to the implement support structure, the working implement being removable, the apparatus comprising:

a frame adapted to attach to said implement support structure upon removal of the working implement, the frame being adapted to be attached, said frame comprising (a) a crosspiece having an upper and a lower wall for engaging said one or more bearing plates, and (b) a spaced pair of longitudinal branches affixed to said crosspiece and adapted to attach to said implement support structure;

an adapter rotatably mounted on said frame with the frame located between the adapter and the implement support structure;

and a working accessory installed on said adapter.

17. Apparatus according to claim 16 wherein said one or more bearing plates each have a bearing aperture, said frame being adapted to connect into said at least one bearing aperture.

18. Apparatus according to claim 16 wherein said adapter comprises:

a body having a first edge adapted to engage the accessory; and one or more locking pins reciprocatably mounted at a second edge of said body, said one or more locking pins being manually operable to lock onto the working accessory, said first edge being opposite said second edge.

19. Apparatus according to claim 16 wherein said working implement comprises an earth moving blade, said working accessory having a function different from said earth moving blade.

20. Apparatus according to claim 16 comprising:

at least one pitch actuator mounted between the frame and the adapter, said at least one pitch actuator being operable to adjust the pitch angle of the adapter.

21. Apparatus according to claim 16 wherein said one or more bearing plates each have a bearing aperture, said upper and said lower wall each being adapted to connect to said bearing aperture of said one or more bearing plates, said upper and said lower wall being arranged to avoid azimuthal rotation of said frame about the one or more bearing plates.

22. Apparatus according to claim 16 comprising:

a resilient line stretched and proximally connected between said pair of longitudinal branches for attenuating vibrations therein.

23. Apparatus according to claim 16 wherein said crosspiece comprises:

a front plate having a plurality of frame bearings for rotatably supporting said adapter.

24. An arrangement for modifying earth moving equipment that has an implement support structure supporting a cross member with one or more bearing plates each with a bearing aperture, the arrangement comprising:

a frame adapted to attach to said cross member and said implement support structure;

an accessory connectable adapter adapted to be rotatably mounted on said frame, said frame comprising:

a crosspiece with an upper and a lower wall adapted to engage said one or more bearing plates; and a spaced pair of longitudinal branches affixed to said crosspiece and adapted to attach to said implement support structure.

* * * * *